US009248547B2

(12) United States Patent
Yamamoto

(10) Patent No.: US 9,248,547 B2
(45) Date of Patent: Feb. 2, 2016

(54) AIR-TYPE SHOT-TREATMENT MACHINE

(75) Inventor: Masatoshi Yamamoto, Toyokawa (JP)

(73) Assignee: SINTOKOGIO, LTD., Nagoya-Shi ( * ) Notice: Subject to any disclaimer, the term of this patent is extended or adjusted under 35 U.S.C. 154(b) by 114 days.

(21) Appl. No.: 13/822,975

(22) PCT Filed: Jun. 29, 2011

(86) PCT No.: PCT/JP2011/003703
§ 371 (c)(1),
(2), (4) Date: Mar. 13, 2013

(87) PCT Pub. No.: WO2012/060028
PCT Pub. Date: May 10, 2012

(65) Prior Publication Data

US 2013/0316622 A1 Nov. 28, 2013

(30) Foreign Application Priority Data

Nov. 2, 2010 (JP) ..... 2010-246368

(51) Int. Cl.
*B24C 3/22* (2006.01)
*B24C 1/10* (2006.01)

(52) U.S. Cl.
CPC .... *B24C 3/22* (2013.01); *B24C 1/10* (2013.01)

(58) Field of Classification Search
CPC ..... B24C 3/22; B24C 1/10; B24C 3/08; B24C 3/086; B24C 3/083
USPC ..... 451/82, 38, 39, 84, 101, 109, 314, 317
See application file for complete search history.

(56) References Cited

U.S. PATENT DOCUMENTS 1,940,972 A * 12/1933 Schwartzkopf ..... 451/90
6,694,789 B2 * 2/2004 Yamamoto et al. ..... 72/53

(Continued)

FOREIGN PATENT DOCUMENTS

EP 0 995 530 A2 4/2000
EP 995530 A2 * 4/2000

(Continued)

OTHER PUBLICATIONS

English-language International Search Report from the European Patent Office for International Application No. PCT/JP2011/003703, mailing date Nov. 9, 2011.

*Primary Examiner* — Monica Carter
*Assistant Examiner* — Lauren Beronja
(74) *Attorney, Agent, or Firm* — Farabow, Garrett & Finnegan, Henderson, Dunner, L.L.P.

(57) ABSTRACT

The purpose of this invention is to reduce the changes in the conditions of the processing for projecting shots, and to downsize the air-type shot-treatment machine 10 and simplify its structure. An air-type shot-treatment machine 10 comprises a table 12 to hold an article to be processed, wherein the table 12 can rotate the article and lift and lower it, a nozzle 16 to project shots toward the article together with compressed air, wherein the nozzle 16 is fixed so that it is oriented toward the article, and is connected to a pressurized tank 46 by means of a connecting device 44 having a wear-resistant hose 40, an adjusting device 18 to adjust the quality of shots projected from the nozzle 16, wherein the adjusting device 18 is disposed at the connecting device 44, a rotating device 20 to rotate the table 12, a moving device 22 to lift and lower the table 12, and a control device 24 to control the adjusting device 18 and the rotating device 20 so that while the table 12 is being rotated, the shots are being projected toward the article to be processed, and, further, to control the moving device 22 so that the table 12 is lifted and lowered.

6 Claims, 7 Drawing Sheets

(56) References Cited

U.S. PATENT DOCUMENTS

| | | | | |
|---|---|---|---|---|
| 7,421,872 | B2 * | 9/2008 | Indlekofer | 72/53 |
| 7,610,786 | B2 * | 11/2009 | Takashima et al. | 72/102 |
| 2002/0155790 | A1 * | 10/2002 | Ido et al. | 451/9 |

FOREIGN PATENT DOCUMENTS

| | | | |
|---|---|---|---|
| EP | 1 254 744 | A2 | 11/2002 |
| EP | 1254744 | A2 * | 11/2002 |
| JP | 08-216024 | | 8/1996 |

* cited by examiner

AIR-TYPE SHOT-TREATMENT MACHINE

TECHNICAL FIELD

This invention relates to an air-type shot-treatment machine.

BACKGROUND OF THE INVENTION

Conventionally, an air-type shot-treatment machine is used for processing products by projecting shots at them. For example, products that have a plurality of gears coaxially disposed on a shaft with predetermined intervals, or products that have a plurality of gears coaxially disposed on a shaft in contact with each other, are processed by projecting shots while a support member to hold the products and a nozzle for projecting the shots are fixed in position.

However, for such a machine, the support member (to hold the gears) must he changed when the respective gears are replaced and processed. Thus, it takes much time to change the tooling for processing the products.

To solve this problem, an air-type shot-treatment machine having a nozzle that can ascend and descend is provided so as to avoid the change of the tooling being required when the respective gears are replaced and processed. (Sec Patent Document 1.)

Patent Document 1: Japanese Patent Laid-open Publication No. H8-216024

DISCLOSURES OF INVENTION

However, for the air-type shot-treatment machine, when the nozzle ascends and descends, the deformation of a wear-resistant hose connecting the nozzle and a pressurized tank is changed. Consequently, it causes a problem, such that the conditions of the processing for projecting shots are changed.

To reduce the changes in the conditions of the processing for projecting shots, the entire nozzle, the pressurized tank, and several types of valves attached to them, etc., can be lifted and lowered together. However, in such a case, much equipment is required, and the machine becomes large. Further, it is possible to equip a plurality of nozzles corresponding to respective gears. However, in such a case, many tanks are required, and piping systems become complicated. Thus, the entire structure of the machine becomes complicated.

This invention is conceived to solve the problems explained in the above paragraphs. The purpose of this invention is to reduce the changes in the conditions of the processing for projecting shots, and to achieve downsizing of the air-type shot-treatment machine and simplification of its structure.

To achieve the purposes explained in the above paragraph, an air-type shot-treatment machine of a first aspect of this invention comprises:

a support member to hold an article to be processed, wherein the member can rotate the article and move the article in a direction along a rotational axis of the support member, a nozzle to project shots toward the article together with compressed air, wherein the nozzle is fixed so that it is oriented toward the article, and is connected to a pressurized tank by means of a connecting device having a wear-resistant hose, an adjusting device to adjust the quantity of shots projected from the nozzle, wherein the adjusting device is disposed at the connecting device, a rotating device to rotate the support member, a moving device to move the support member in a direction along a rotational axis of the support member, and a control device to control the adjusting device and the rotating device so that while the support member is being rotated, the shots are projected toward the article held by the support member, and, further, to control the moving device so that the support member is moved in the direction along the rotational axis of the support member.

For the present air-type shot-treatment machine, the nozzle is fixed so that it is oriented toward the article. Thus, any change of the deformation of the wear-resistant hose connecting the nozzle and a pressurized tank can be eliminated. Consequently, the change of the conditions of the processing for projecting shots can be eliminated.

Further, the support member is movable in a direction along its rotational axis by means of the moving device controlled by the control device.

Thus, since the present machine can he downsized compared to a system in which the entire nozzle, pressurized tank, and several types of valves attached to them, etc., are lifted and lowered together, the structure of the machine can he simplified.

An air-type shot-treatment machine of a second aspect has the following constitution:

the air-type shot-treatment machine of the first aspect, wherein the support member can be moved in a vertical direction that corresponds to the direction along the rotational axis of the support member, wherein the nozzle can project shots in the horizontal direction, and wherein the moving device has a motor for moving the support member in the direction along the rotational axis of the support member, which motor is disposed above the support member.

For the present air-type shot-treatment machine, the motor for moving the support member in the direction along the rotational axis of the support member, which motor acts as a driving source disposed at the moving device, is disposed above the support member. Thus, the shots projected from the nozzle can he prevented from hitting the motor for moving the support member.

An air-type shot-treatment machine of a third aspect has the following constitution:

the air-type shot-treatment machine of the first or the second aspect, the moving device further comprising:

the motor for moving the support member, wherein the motor is disposed at the side of one end of the rotational axis of the support member, and a moving portion integrated with the rotating device, wherein the moving portion can move in the direction of the rotational axis of the support member together with the support member, and can move in the direction of the rotational axis of the support member by means of the rotational force of the motor for moving the support member, and the rotating device further comprising:

a mechanism for transmitting a rotational force connected to the support member, wherein the mechanism is disposed at the side of the other end of the rotational axis of the support member, and a motor for rotating the support member to give a rotational force to the support member by means of the mechanism for transmitting the rotational force, wherein the motor is disposed at the side of one end of the mechanism for transmitting a rotational force in the direction of the rotational axis of the support member.

For the present air-type shot-treatment machine, the mechanism for transmitting a rotational force of the rotational device is disposed at the side of the other end of the rotational axis of the support member, namely, at the side opposite the location of the motor for moving the support member. Further, the motor for rotating the support member is disposed at the side of one end of the mechanism for transmitting a rotational force in the direction of the rotational axis of the support member, namely, at the side of the mechanism toward the motor for moving the support member. Thus, compared to when the motor for rotating the support member is disposed at the side of the other end of the mechanism, the air-type shot-treatment machine can be downsized in the direction of the rotational axis of the support member.

An air-type shot-treatment machine of a fourth aspect has the following constitution:

the air-type shot-treatment machine of the third aspect, wherein the moving portion has a box-like shaped housing, and the motor for rotating the support member is disposed in the housing of the moving portion.

For the present air-type shot-treatment machine, the motor for rotating the support member is disposed in the housing of the moving portion, which housing has a box-like shape. Thus, the shots projected from the nozzle can be prevented from hitting the motor for rotating the support member.

An air-type shot-treatment machine of a fifth aspect has the following constitution:

the air-type shot-treatment machine of any one of the first to the fourth aspects, wherein the machine processes the products that have a plurality of gears coaxially disposed on a shaft with predetermined intervals, and wherein the shaft is held by the support member so that the longitudinal direction of the shaft corresponds to the rotational axis of the support member, and wherein the control device controls the moving device so that the following steps are alternately carried out:

a step for stopping the support member moving in the direction of its rotational axis at the position where the shots can he projected toward any one of the plurality of gears, and a step for moving the support member in the direction of its rotational axis to change the gear to be processed by projecting the shots from one to another of the plurality of gears.

For the present air-type shot-treatment machine, even though the products have a plurality of gears coaxially disposed on a shaft with predetermined intervals, the following steps are alternately carried out:

a step for stopping the support member moving in the direction of its rotational axis at the position where the shots can be projected toward any one of the plurality of gears, and a step for moving the support member in the direction of its rotational axis to change the gear to be processed by projecting the shots from one to another of the plurality of gears.

Thus, even though the plurality of gears are spaced apart from each other, each gear can be properly processed by projecting the shots toward the gear.

An air-type shot-treatment machine of a sixth aspect has the following constitution:

the air-type shot-treatment machine of any one of the first to the fourth aspects, wherein the machine processes the products that have a plurality of gears coaxially disposed on a shaft in contact with each other, and wherein the shaft is held by the support member so that the longitudinal direction of the shaft corresponds to the rotational axis of the support member, and wherein the control device controls the moving device so that the plurality of gears are processed in series by projecting the shots toward them while the support member is continuously moved.

For the present air-type shot-treatment machine, even though the products have a plurality of gears coaxially disposed on a shaft in contact with each other, since the support member is continuously moved, the plurality of gears are processed in series by projecting the shots toward them. Thus, the plurality of gears disposed on a shaft in contact with each other can be efficiently processed.

An air-type shot-treatment machine of a seventh aspect has the following constitution:

the air-type shot-treatment machine of any one of the first to the sixth aspects, wherein the control device controls the moving device so that the speed of the movement of the support member is changed in response to the shape of the article to be processed.

For the present air-type shot-treatment machine, since the speed of the movement of the support member is changed in response to the shape of the article to be processed, the article can be properly processed in response to the shape of the article.

Effects of the Invention

As explained in the above paragraphs in detail, based on the present invention the change of the conditions of the processing for projecting shots can be eliminated. Further, the air-type shot-treatment machine can be downsized, and the structure of the machine can be simplified.

PREFERRED EMBODIMENT OF THE INVENTION

Based on the figures, below an embodiment of this invention is explained.

Figure 1:
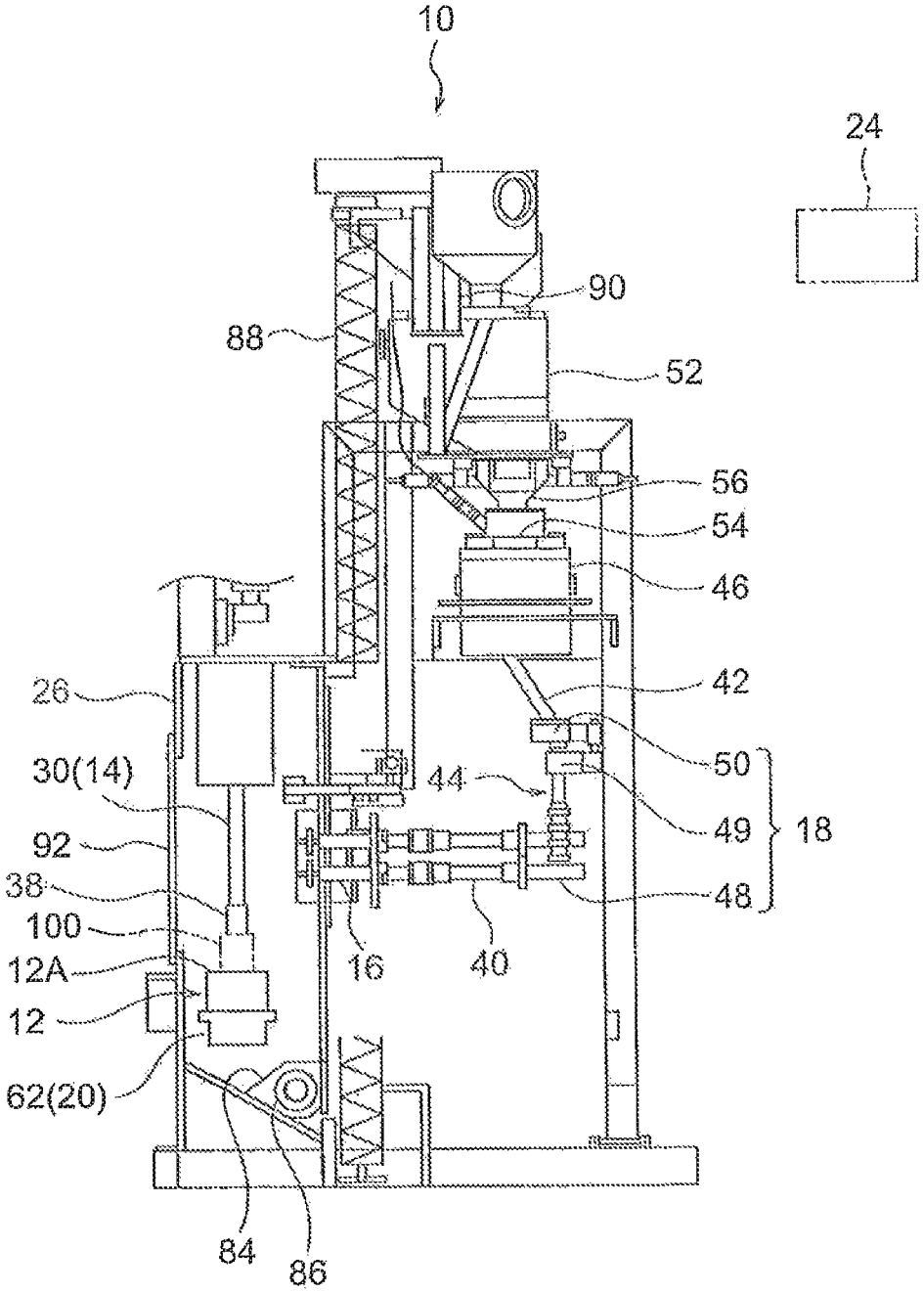
FIG. 1 shows a side view of a tank, which is a part of an air-type shot-treatment machine of an embodiment of this invention.
Figure 2:
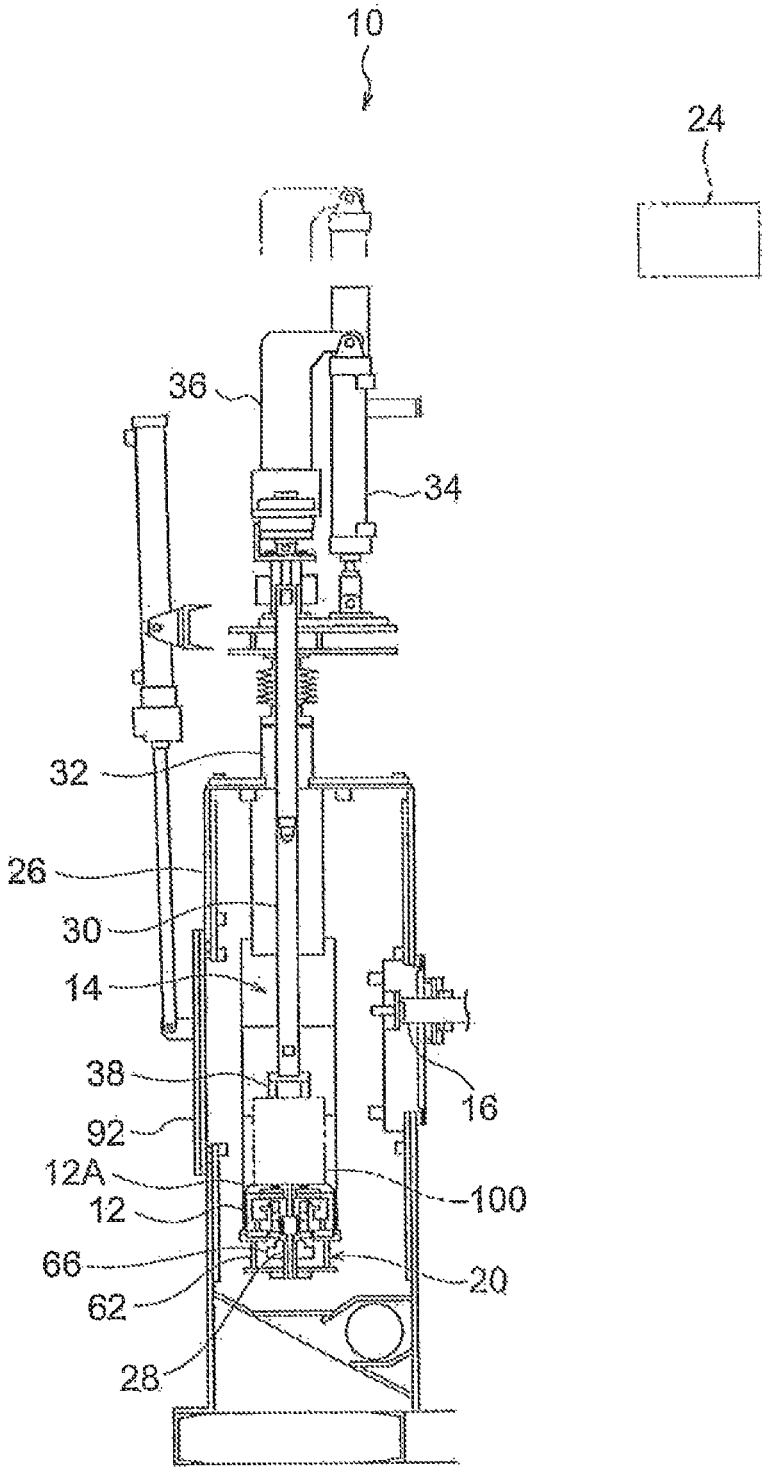
FIG. 2 shows a side sectional view of the air-type shot-treatment machine of FIG. 1.
Figure 3:
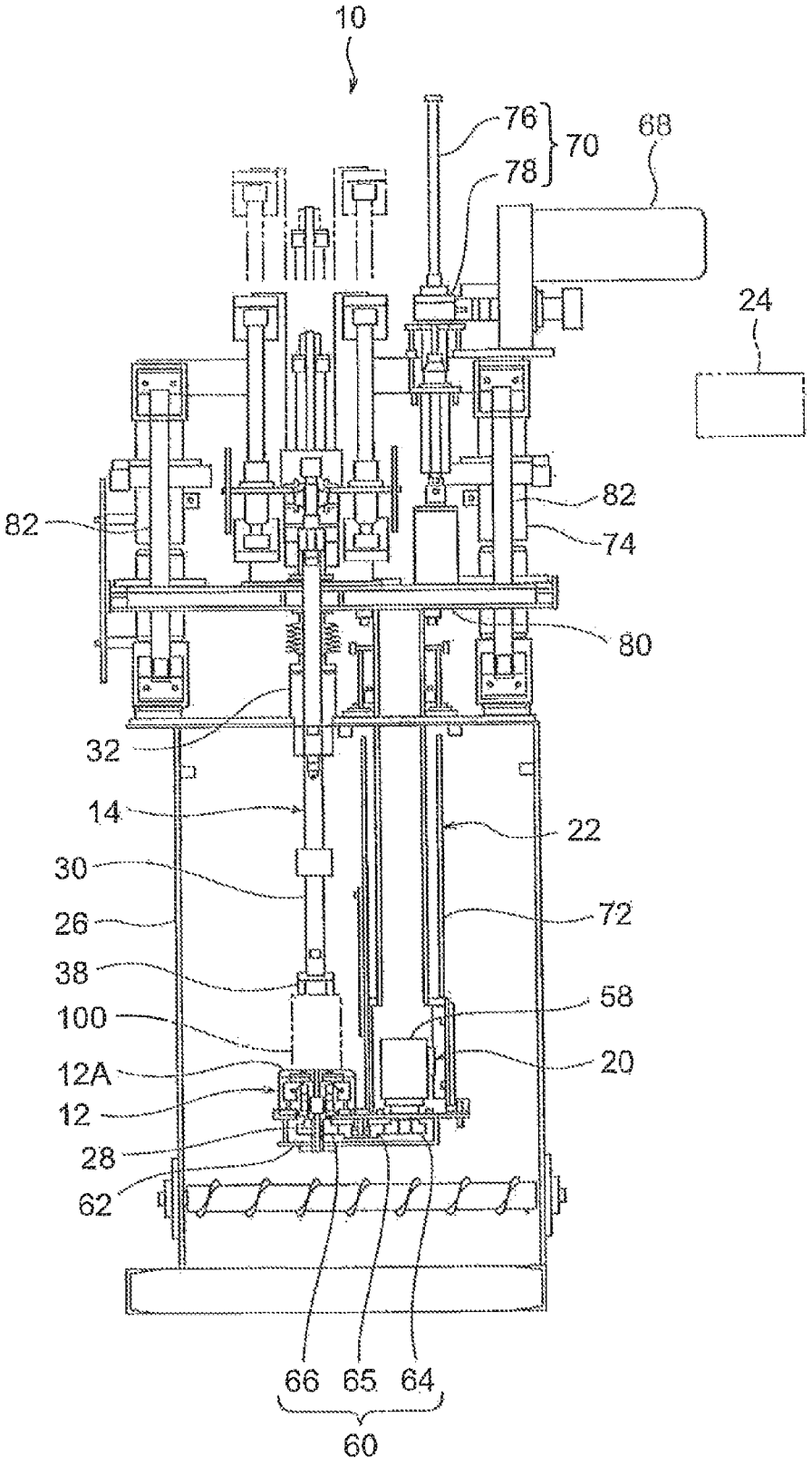
FIG. 3 shows a front sectional view of the air-type shot-treatment machine of FIG. 1.

The air-type shot-treatment machine 10 of an embodiment of this invention, which machine is shown in FIGS. 1-3, is used for shot peening treatment works, for example. The machine 10 comprises a table 12, which acts as a support member, a holding mechanism 14, a nozzle 16, an adjusting device 18 to adjust the quantity of shots, a rotating device 20, a lifting and lowering device 22, which acts as a moving device, a control device 24, and a cabinet 26.

As shown in FIG. 2, the table 12 is housed in the cabinet 26 and has a rotational shaft 28 disposed on the central axis of the table 12. The rotational shaft 28 extends in the vertical direction and is rotatably supported by a case 62 of the rotating device 20, which device 20 is explained below in detail. The upper surface 12A of the table 12 is formed as a surface for supporting products 100, which are articles to he processed. There are gears of an automatic transmission (AT parts), as an example of the products 100 to be processed.

The holding mechanism 14 comprises a holding rod 30, a rotating mechanism 32, an air cylinder 34, and a lever 36. The holding rod 30 extends in the vertical direction. The lower portion of the holding rod 30, which portion corresponds to the lower part from the center of the holding rod 30 in the longitudinal direction, is housed in the cabinet 26. A holding part 38 is disposed at the lower end of the holding rod 30 to push the products 100 toward the table 12.

The rotating mechanism 32 is disposed at the upper wall of the cabinet 26. The rotating mechanism 32 supports the holding rod 30 so that it is rotatably and slidingly supported in the vertical direction by the upper wall of the cabinet 26. The air cylinder 34 is connected to the rotating mechanism 32 by means of the lever 36.

For this holding mechanism 14, the pushing force of the air cylinder 34 is transferred to the holding rod 30 by means of the lever 36. Consequently, the holding rod 30 pushes the products 100 toward the upper surface 12A of the table 12.

The nozzle 16 is fixed to the side wall of the cabinet 26 so that the nozzle 16 does not move in the vertical direction and against the table 12. The nozzle 16 is oriented in the horizontal direction toward the central portion of the cabinet 26 where the products 100 are disposed.

As shown in FIG. 1, the nozzle 16 is connected to a pressurized tank 46 by means of a connecting device 44, comprising a wear-resistant hose 40 and a steel pipe 42.

An adjusting device 18 to adjust the amount of shots comprises a mixing valve 48, which is disposed at the connecting device 44 explained in the above paragraph, adjusting equipment 49, and a cut gate 50 (a shutoff valve).

The pressurized tank 46 is connected to a tank 52 for storing shots, and comprises a poppet valve 54 and a proportional feeder 56, which are disposed between the pressurized tank 46 and the tank 52 for storing shots.

For this air-type shot-treatment machine 10, if a shortage of the shots in the pressurized tank 46 is caused, the poppet valve 54, disposed on the pressurized tank 46, is opened, and then appropriate quantities of shots are transferred to the pressurized tank 46 by means of the proportional feeder 56. When the quantity of the shots in the pressurized tank 46 reaches a predetermined level, the proportional feeder 56 and the poppet valve 54 are shut down, and then the pressurized tank 46 is compressed. Then after compressed air flows to the mixing valve 48, the cut gate 50 and the adjusting equipment 49 are opened, and then an appropriate quantity of shots is transferred to the mixing valve 48 from the pressurized tank 46 through the steel pipe 42, the cut gate 50, and the adjusting equipment 49.

Since the shots are kept up by a stream of compressed air flowing to the mixing valve 48, the shots are accelerated. Then the shots are projected in the horizontal direction together with the compressed air from the nozzle 16 through the wear-resistant hose 40. For example, rounded cut wires made, by Toyo Seiko Co., Ltd., can be used as the shots.

The rotating device 20 rotates the table 12. As shown in FIG. 3, the rotating device 20 is integrated with a moving portion 72 of a lifting and lowering device 22, which is explained below in detail. The rotating device 20 comprises a motor for rotating the support member 58, a mechanism for transmitting a rotational force 60, and the case 62. The motor for rotating the support member 58 is disposed above the mechanism for transmitting a rotational force 60 and is disposed in the moving portion 72, which has a box-like shaped housing.

The mechanism for transmitting a rotational force 60 is disposed below the table 12 and comprises a plurality of gears 64, 65, 66. The gear 64 is fixed to the rotational shaft of the motor for rotating the support member 58. The gear 65 is engaged with the gear 64 and is rotatable supported by the case 62. Further, the gear 66 is engaged with the gear 65 and fixed to the rotational shaft 28.

When the motor for rotating the support member 58 is driven, the rotational force of the motor 58 is transferred to the rotational shaft 28 by way of the plurality of gears 64, 65, 66, and then the table 12 is rotated.

The lifting and lowering device 22 lifts and lowers the table 12. The device 22 comprises a motor for lifting and lowering the support member 68, which motor acts as the motor for moving the support member, a ball screw assembly 70, and the moving portion 72. The motor for lifting and lowering the support member 68 is disposed on the upper wall of the cabinet 26 by means of a support structure 74, and is positioned above the table 12.

The ball screw assembly 70 comprises a screw 76 extending vertically, and a nut 78 engaged with the screw 76. The screw 76 is connected to a slider 80. The slider 80 is supported by a pair of rails 82 disposed at the support structure 74, and can slide in a vertical direction. The slider 80 is integrated with and fixed to the moving portion 72. The nut 78 is connected to the rotating shaft of the motor for lifting and lowering the support member 68 by means of a mechanism for transmitting a rotational force (not shown).

When the motor for lifting and lowering the support member 68 is driven, the rotational force of the motor 68 is transferred to the nut 78. Then when the nut 78 is rotated, since the screw 76 moves forward and backward against the nut 78, the table 12 is lifted and lowered together with the slider 80 and the moving portion 72. The air-type shot-treatment machine 10 is a vertical-type machine. Namely, the direction of the rotational axis of the support member corresponds to the vertical direction, and the table 12 can move in that direction.

The control device 24 comprises an electrical circuit inside the device 24. The control device 24 controls the movements of the mixing valve 48, the adjusting equipment 49, the cut gate 50, the poppet valve 54, the proportional feeder 56, the motor for rotating the support member 58, the motor for lifting and lowering the support member 68, etc. The details of the function of the control device 24 are explained later, together with an explanation on the shot peening treatment.

The air-type shot-treatment machine 10 further comprises the following elements for recovering the shots, in addition to the system explained in the above paragraphs: Namely, for the air-type shot-treatment machine 10, as shown in FIG. 1, the shots projected toward the products 100 are collected in a hopper 84 disposed below the table 12, transferred to a horizontal screw-type conveyor 86, and then lifted by means of a vertical screw-type conveyor 88. The lifted shots are stored in the tank 52, and then pass through a separator 90.

Figure 4:
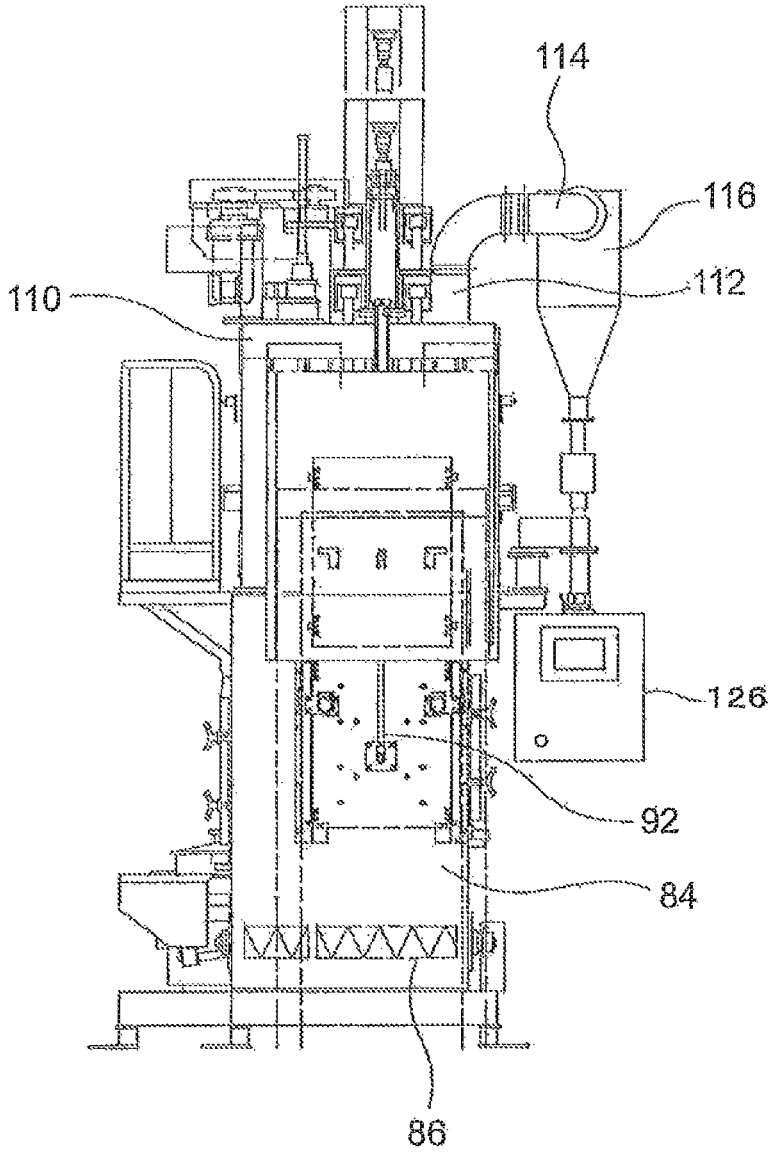
FIG. 4 shows an elevational view of an air-type shot-treatment machine of an embodiment of this invention, which shows the entire constitution of the machine.
Figure 5:
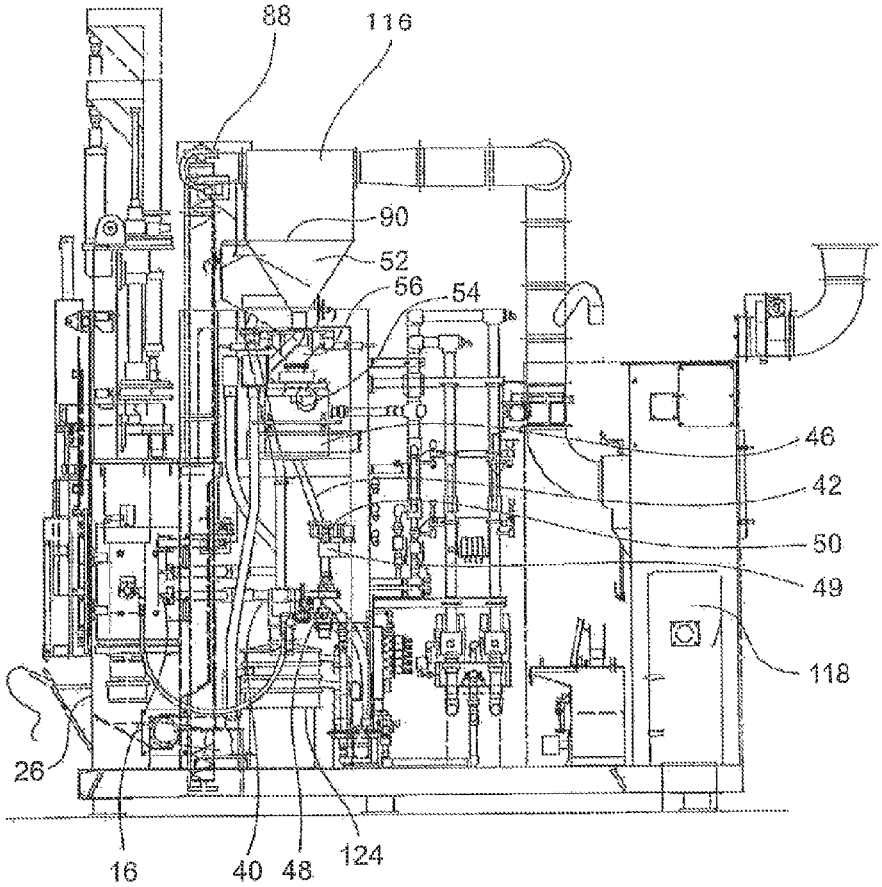
FIG. 5 shows a side view of an air-type shot-treatment machine of an embodiment of this invention, which shows the entire constitution of the machine.
Figure 6:
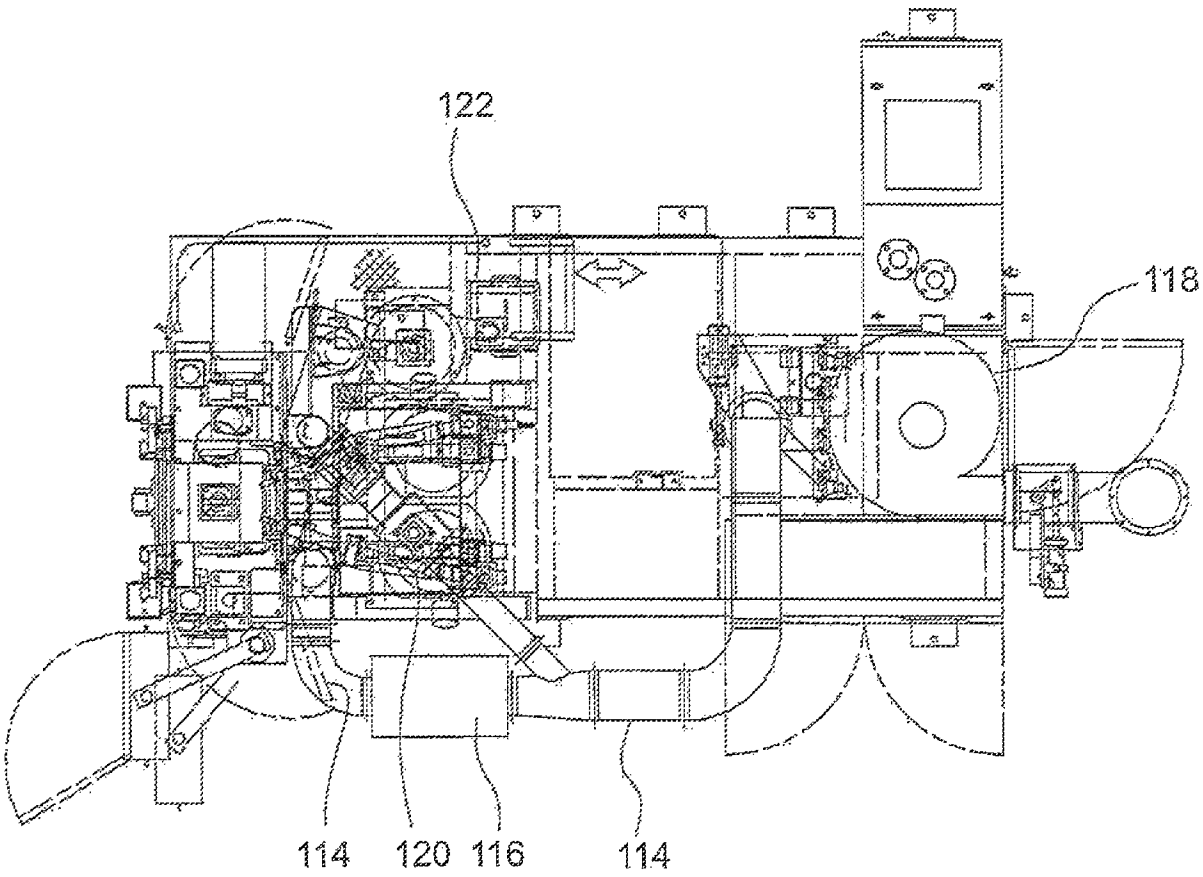
FIG. 6 shows a plane view of an air-type shot-treatment machine of an embodiment of this invention, which shows the entire constitution of the machine.

The entire constitution of the air-type shot-treatment machine 10 is shown in FIGS. 4-6. For the air-type shot-treatment machine 10, dust generated in the cabinet 26 during the shot peening treatment is transferred to a dust collector 118 from a suction port 112 together with air suctioned by a ventilator 110 through a duct 114 and a settling chamber 116. At the dust collector 118, the dust is filtered, and air is discharged. The dust suctioned from the separator 90 is transferred to the dust collector 118 through a settling chamber 120, and is filtered. A fine powder that is filtered at the settling chamber 116 and the settling chamber 120 is transferred to a box 122 for receiving fine powder. Some of the shots are transferred to a sieve 124 for classifying the shots from the tank 52 for storing shots. The usable shots are transferred to the lower portion of the vertical screw-type conveyor 88, and are reused. The fine powder separated by the sieve 124 for classifying the shots is transferred to the box 122 for receiving fine powder.

Next, the operation of the air-type shot-treatment machine 10 and the method for shot peening the products 100 are explained.

Below, two examples for processing two types of products 100 are explained. One type of products 100 is a plurality of gears 104 coaxially integrated with a shaft 102 with predetermined intervals (see FIG. 7), and the other type of products 100 is a plurality of gears 108 coaxially disposed on a shaft 106 in contact with each other (see FIG. 8).

First, an ascending and descending door 92, shown in FIG. 1, of the cabinet 26, is opened. Then a product 100 is placed on the upper surface 12A of the table 12. At that time, the shaft 102 is held by the table 12 so that the longitudinal direction of the shaft 102 corresponds to the vertical direction. Then the ascending and descending door 92 is closed, and the product 100 is fixed on the table 12 by means of the holding mechanism 14.

Next, a start switch on a console panel 126, shown in FIG. 4, is turned on. Based on this operation, a start signal is transmitted from the console panel 126 to the control device 24. When the control device 24 receives the start signal, the device 24 rotates the table 12 by driving the motor for rotating the support member 58, and then starts the processing for shot peening the product 100 by projecting the shots from the nozzle 16 toward the product 100, while controlling the mixing valve 48, the adjusting equipment 49, the cut gate 50, the poppet valve 54, the proportional feeder 56, etc.

Figure 7:
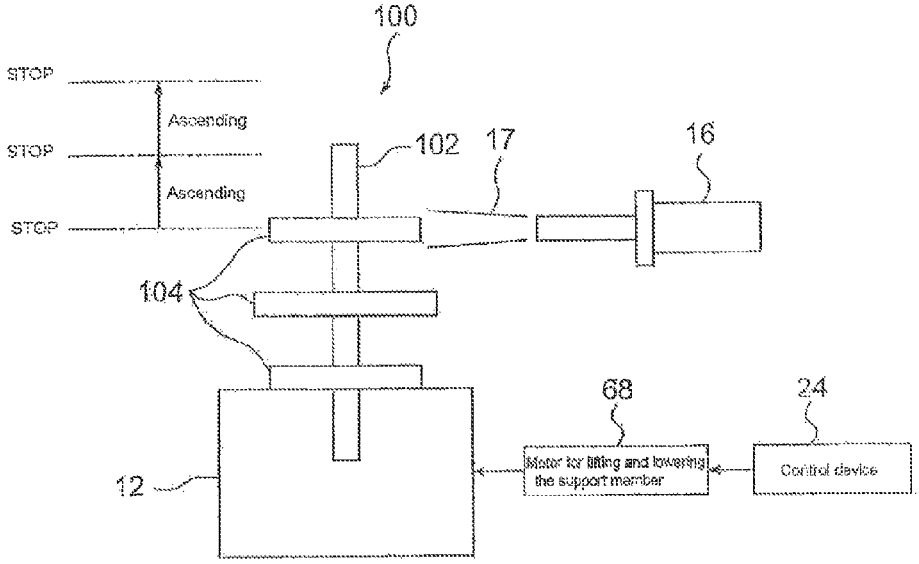
FIG. 7 shows an explanatory diagram of the operation of the air-type shot-treatment machine when the products that have a plurality of gears that are coaxially disposed on a shaft with a predetermined interval are processed.

When the product 100 that has a plurality of gears 104 coaxially integrated with a shaft 102 with predetermined intervals, as shown in FIG. 7, is processed, the control device 24 controls the motor for lifting and lowering the support member 68 so that the following steps are alternately carried out:

a step for stopping the table 12 moving in the direction of its rotational axis at the position where the shots 17 can be projected toward any one of the plurality of gears 104, and a step for moving the table 12 in the direction of its rotational axis to change the gear to be processed by projecting the shots from one to another of the plurality of gears 104.

Namely, when the product 100 has three gears 104, the control device 24 controls the motor for lifting and lowering the support member 68 so that the table 12 is stopped at three respective positions, where the gears 104 can be processed.

At that time, by controlling the motor for lifting and lowering the support member 68 based on the signals transmitted from a sensor disposed at the motor 68, the control device 24 controls the motor 68 and precisely stops the table 12 at the required positions so that the shots projected from the nozzle 16 can properly hit each gear 104.

Figure 8:
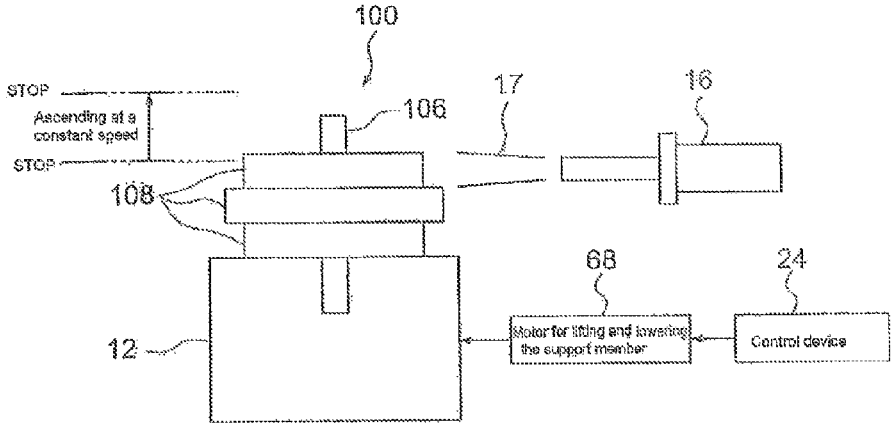
FIG. 8 shows an explanatory diagram of the operation of the air-type shot-treatment machine when the products that have a plurality of gears coaxially disposed on a shaft in contact with each other are processed.

In contrast, as shown in FIG. 8, when the product 100 that has a plurality of gears 108 coaxially disposed on a shaft 106 in contact with each other is processed, the control device 24 controls the motor for lifting and lowering the support member 68 so that the plurality of gears 108 are processed in series by projecting the shots toward them while the table 12 is continuously lifted.

At that time, by controlling the motor for lifting and lowering the support member 68 based on the signals transmitted from a sensor disposed at the motor 68, the control device 24 controls the motor 68 so that the table 12 can be continuously lifted at a constant speed.

Further, at that time, the control device 24 controls the motor for lifting and lowering the support member 68 so that the speed of ascent of the table 12 is changed in response to the shape of the product 100 to be processed. For example, when the thickness or the diameter of the gears 104 (108) is large, the speed of ascent of the table 12 is reduced. In contrast, when the thickness or the diameter of the gears 104 (108) is small, the speed of ascent of the table 12 is increased.

When the shot peening treatment is completed, the control device 24 stops projecting the shots by controlling the movements of the mixing valve 48, the adjusting equipment 49, the cut gate 50, the poppet valve 54, the proportional feeder 56, etc. Then the control device 24 stops the motor for rotating the support member 58 and the motor for lifting and lowering the support member 68. Then the product 100 is released from being held by the holding mechanism 14, the ascending and descending door 92 is opened, and the product 100 is taken out from the cabinet 26. Based on all of these operations, the shot peening treatment is completed.

Below, the effects of the embodiments of this invention are explained.

For the air-type shot-treatment machine 10 of one embodiment of this invention, the nozzle 16 is fixed in the vertical direction. Thus, any change of the deformation of the wear-resistant hose 40 connecting the nozzle 16 and the pressurized tank 46 can be eliminated. Consequently, the change in the conditions for the processing for projecting shots can be eliminated.

Further, the table 12 can ascend and descend in a direction along its rotational axis and is lifted and lowered by the lifting and lowering device 22, which is controlled by the control device 24. Thus, since the present machine can be downsized compared to a system in which the entire nozzle 16, a pressurized tank 46, and several types of valves attached to them, etc., are lifted and lowered together, the structure of the machine can be simplified.

Further, as shown in FIG. 3, the motor for lifting and lowering the support member 68, which motor acts as a driving source disposed at the lifting and lowering device 22, is disposed above the table 12. Thus, the shots projected from the nozzle 16 can be prevented from hitting the motor 68.

Further, the mechanism for transmitting a rotational force 60 of the rotating device 20 is disposed below the table 12. In contrast, the motor for rotating the support member 58 is disposed above the mechanism 60. Namely, the motor 58 is disposed at the side of the mechanism 60 toward the motor for lifting and lowering the support member 68.

Thus, compared where the motor 58 is disposed below the mechanism 60, the air-type shot-treatment machine 10 can be downsized in the vertical direction.

Further, the motor for rotating the support member 58 is disposed in the housing of the moving portion 72, which housing has a box-like shape. Thus, the shots projected from the nozzle 15 can he prevented from hitting the motor 58.

Further, as shown in FIG. 7, even though the product 100 has a plurality of gears 104 coaxially disposed on a shaft 102 at predetermined intervals, the following steps are alternately carried out:

a step for stopping the table 12 ascending at the position where the shots can be projected toward any one of the plurality of gears 104, and a step for lifting the table 12 to change the gear 104 to be processed by projecting the shots 17 from one to another of the plurality of gears 104.

Consequently, even though the plurality of gears are spaced apart from each other, each gear 104 can be properly processed by projecting the shots 17 toward the gear 104.

Further, as shown in FIG. 8, even though the product 100 has a plurality of gears 108 coaxially disposed on a shaft 106 in contact with each other, since the table 12 is continuously moved, the plurality of gears 108 are processed in series by projecting the shots 17 toward them.

Thus, the plurality of gears 108 that are disposed on a shaft 106 in contact with each other can be efficiently processed.

Further, since the speed of the movement of the table 12 is changed in response to the shape of the product 100 to be processed, the product 100 can be properly processed in response to its shape.

Below, examples of the modification of the embodiments of this invention are explained.

In the embodiments explained in the above paragraphs, the air-type shot-treatment machine 10 is used as a shot peening treatment machine. However, it may be used as a shot blasting machine.

Further, in the embodiments explained in the above paragraphs, the table 12 is used as a support member. However, a hanger that is suspended from an upper portion of the machine may be used as a support member.

Further, in the embodiments explained in the above paragraphs, as shown in FIGS. 7 and 8, the control device 24 controls the table 12 so that the table 12 ascends so as to carry out the shot peening treatment from the top gear of the plurality of gears 104 (108).

However, the table 12 may be controlled so that it descends so as to carry out the shot peening treatment from the bottom gear of the plurality of gears 104 (108).

Further, in the embodiments explained in the above paragraphs, the air-type shot-treatment machine 10 is a vertical type. However, it may he a horizontal type. In this case, the rotational axis of the table 12 extends horizontally.

In the above paragraphs, the embodiments of the invention are explained.

However, the invention is not limited to those embodiments, and it is obvious that other many modifications may be made within the scope of the invention.

EXPLANATION OF DENOTATIONS

10 an air-type shot-treatment machine
12 a table (a support member)
16 a nozzle
18 an adjusting device to adjust the quantity of shots
20 a rotating device
22 a lifting and lowering device (a moving device)
24 a control device
40 a wear-resistant hose
44 a connecting device
46 a pressurized tank
58 a motor for rotating a support member
60 a mechanism for transmitting a rotational force
68 a motor for lifting and lowering a support member (a motor for moving a support member)
72 a moving portion

The invention claimed is:

1. An air-type shot-treatment machine comprising:

a support member to hold an article to be processed, wherein the member can rotate the article and move the article in a direction along a rotational axis of the support member, a nozzle to project shots toward the article together with compressed air, wherein the nozzle is fixed so that it is oriented toward the article, and is connected to a pressurized tank by means of a connecting device having a wear-resistant hose, an adjusting device to adjust a quantity of shots to be projected from the nozzle, wherein the adjusting device is disposed at the connecting device, a rotating device to rotate the support member, a moving device to move the support member in a direction along the rotational axis of the support member, and a control device to control the adjusting device and the rotating device so that while the support member is being rotated, the shots are projected toward the article held by the support member, and further to control the moving device so that the support member is moved in the direction along the rotational axis of the support member, wherein the moving device further comprises:

the motor for moving the support member in a direction of the rotational axis of the support member, wherein the motor is disposed at the side of one end of the rotational axis of the support member, and a moving portion that is integrated with the rotating device, wherein the moving portion can move in the direction of the rotational axis of the support member together with the support member, and can move in the direction of the rotational axis of the support member by means of the rotational force of the motor for moving the support member, and wherein the rotating device further comprises:

a mechanism for transmitting a rotational force connected to the support member, wherein the mechanism is disposed at the side of the other end of the rotational axis of the support member, and a motor for rotating the support member to give a rotational force to the support member by means of the mechanism for transmitting the rotational force, wherein the motor is disposed at the side of one end of the mechanism for transmitting a rotational force in the direction of the rotational axis of the support member, the side of one end of the mechanism for transmitting a rotational force facing toward the motor for moving the support member, and wherein the support member is disposed at one side in the direction of the rotational axis of the support member relative to the mechanism for transmitting a rotational force, and the motor for rotating the support member is disposed at the one side in the direction of the rotational axis relative to the mechanism for transmitting a rotational force.

2. The air-type shot-treatment machine of claim 1, wherein the support member can be moved in a vertical direction that corresponds to the direction along the rotational axis of the support member, wherein the nozzle can project shots in the horizontal direction, and wherein the moving device has a motor for moving the support member in the direction along the rotational axis of the support member, which motor is disposed above the support member.

3. The air-type shot-treatment machine of claim 1, wherein the moving portion has a box-like shaped housing, and the motor for rotating the support member is disposed in the housing of the moving portion.

4. The air-type shot-treatment machine of any one of claims 1, 2 or 3, wherein the machine processes products that have a plurality of gears coaxially disposed on a shaft at predetermined intervals, and wherein the shaft is held by the support member so that the longitudinal direction of the shaft corresponds to the rotational axis of the support member, wherein the control device controls the moving device so that the following steps are alternately carried out:

a step for stopping the support member moving in the direction of its rotational axis at the position where the shots can be projected toward any one of the plurality of gears, and a step for moving the support member in the direction of its rotational axis to change the gear to be processed by projecting the shots from one to another of the plurality of gears.

5. The air-type shot-treatment machine of any one of claims 1, 2 or 3, wherein the machine processes the products that have a plurality of gears coaxially disposed on a shaft in contact with each other, and wherein the shaft is held by the support member so that the longitudinal direction of the shaft corresponds to the rotational axis of the support member, and wherein the control device controls the moving device so that the plurality of gears are processed in series by projecting the shots toward them while the support member is continuously moved.

6. The air-type shot treatment machine of any one of claims 1, 2 or 3, wherein the control device controls the moving device so that the speed of the movement of the support member is changed in response to the shape of the article to be processed.

* * * * *